US005277211A

United States Patent [19]

Hendershot

[11] Patent Number: 5,277,211

[45] Date of Patent: Jan. 11, 1994

[54] GOLF BAG UMBRELLA

[76] Inventor: Allen R. Hendershot, #1 Hess Ct., Moundsville, W. Va. 26041

[21] Appl. No.: 57,863

[22] Filed: May 7, 1993

[51] Int. Cl.[5] ..... A45B 3/00

[52] U.S. Cl. ..... 135/16; 135/19; 135/25.4

[58] Field of Search ..... 135/16, 19, 20.3, 25.4; 248/514, 538; 224/274

[56] References Cited

U.S. PATENT DOCUMENTS

| | | | |
|---|---|---|---|
| 970,751 | 9/1910 | Pranke | 135/16 X |
| 2,559,421 | 7/1951 | Garrett . | |
| 2,905,187 | 9/1959 | Croce . | |
| 2,906,278 | 9/1959 | Small . | |
| 3,145,720 | 8/1964 | Torii . | |
| 3,304,035 | 2/1967 | Davis . | |
| 3,419,295 | 12/1968 | Small . | |
| 3,765,434 | 10/1973 | Riggs . | |
| 3,866,934 | 2/1975 | Braun | 135/16 X |
| 4,188,965 | 2/1980 | Morman | 135/16 |
| 4,455,030 | 6/1984 | Rosen | 135/16 X |
| 4,522,300 | 6/1985 | Hamblet | 135/16 X |
| 4,877,045 | 10/1989 | Lin . | |
| 5,086,797 | 2/1992 | Earnshaw et al. . | |
| 5,141,010 | 8/1992 | Muller et al. | 135/20.3 |

FOREIGN PATENT DOCUMENTS

| | | | |
|---|---|---|---|
| 156518 | 7/1883 | France | 248/514 |
| 1044098 | 6/1953 | France | 248/514 |

*Primary Examiner*—David A. Scherbel
*Assistant Examiner*—Lan M. Mai
*Attorney, Agent, or Firm*—Richard C. Litman

[57] ABSTRACT

A golf bag umbrella attached to the side of a golf bag for protecting the open end of the bag and golf clubs therein from the elements. The umbrella includes an articulated shaft, pivoted and locked by a button latch located above a lower end handle grip on the shaft. The umbrella ribs may be overbuilt to provide a strengthened umbrella that resists being everted in a moderate to strong wind. The umbrella may be removed and pivoted against the ground by a single hand of the user. The umbrella is readily attached to and removed from the bag by use of a pair of spring clips or clamps. During play in inclement weather, the golfer may use the umbrella conventionally, to protect himself, and then clip the open umbrella onto the bag, to protect the bag while taking a shot or stroke, and then readily detach the umbrella from the bag for protection, as the golfer walks to the ball to take another stroke. Also, with the umbrella clipped to the bag while taking a stroke, the umbrella will not blow away in the wind, as often happens with conventional umbrellas.

5 Claims, 2 Drawing Sheets

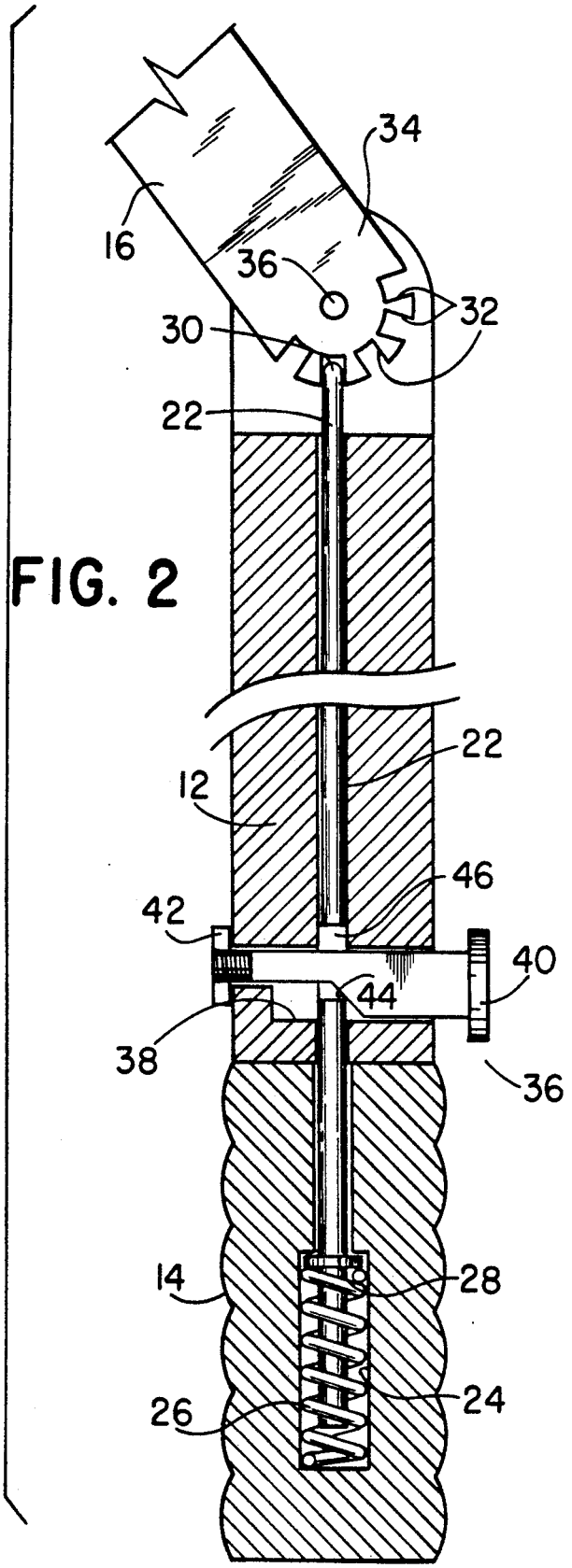
FIG. 2
FIG. 3
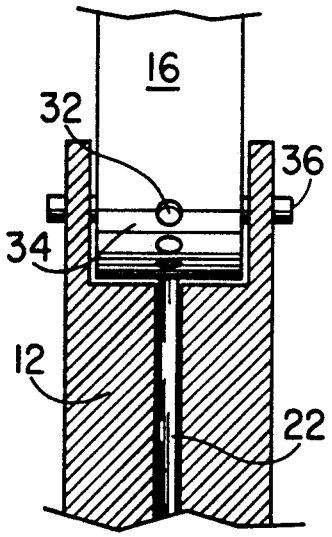

GOLF BAG UMBRELLA

BACKGROUND OF THE INVENTION

1. Field of the Invention

The present invention relates to umbrellas and, more particularly, to a golf bag attached umbrella with an articulated shaft, and dimensioned and strengthened so as to be immediately useable in the event of rain, to protect the open upper end of the golg bag and the golf clubs therein.

2. Description of the Prior Art

There exists a need for a readily available and deployable umbrella for golfers to use so that play can continue under showery conditions. It is important to be able to protect clubs, particularly the woods, should it rain while one is playing golf, and this is not an uncommon occurrence. Although many quality golf bags are known which are equipped with covers for the open top of the bag, often there is insufficient time to deploy such bag covers when a shower or rain arises suddenly. As for the classic golf umbrella, this is suitable for the player, but play must be interrupted since is difficult to place the umbrella and hold the same over the open top of the golf bag; most golfers would want to assure that the clubs stay dry, even at the expense of the golfer getting a little wet. Also, it is common for prior art umbrellas to become everted during even a moderate wind condition, thereby rendering the umbrella quite useless and, often enough, damaging the umbrella.

The instant invention solves these problems by providing an umbrella of extra strong construction, and a clip mount system, for holding the umbrella securely on a golf bag, the umbrella being easily opened to cover the clubs or club heads at the open end of the golf bag, the umbrella shaft being articulated and easily adjustable to a selected attitude by one hand operation only.

Several prior art umbrella constructions are relevant, and the following patents represent a cross section of several known umbrellas, including umbrellas with articulated shafts. The most relevant of the patents which are discussed herein is U.S. Pat. No. 3,304,035 issued Feb. 14, 1967 to Claude R. Davis, disclosing a golf cart attached umbrella including a crook necked, adjustable, articulated umbrella shaft having a base member semi-permanently attached to the golf cart handle. The umbrella is eccentrically shaped and may be detached from the cart. It is designed to protect the golfer from sun and rain, rather than the golf bag and clubs, and no provision is made for attaching the umbrella shaft directly to the bag.

The following patents are directed to somewhat more remote umbrella constructions. U.S. Pat. No. 2,905,187 issued Sep. 22, 1959 to R. Croce shows a garden umbrella with an articulated shaft, whereby the umbrella may be adjusted to one of three stable, locked positions or attitudes. However, the adjustment assembly is located directly at the pivot point on the umbrella shaft, no handle is provided, and the use of the invention is remote from the needs of golfers. Another umbrella having a three position tilting upper shaft, but with a button end key member for moving and latching the umbrella shaft in position being located almost directly at the pivot point of the assembly, rather than remotely therefrom, is seen in U.S. Pat. No. 4,877,045 issued Oct. 31, 1989 to Chin-Hui Lin. Another three or more position pivot shaft for an umbrella, again with an operating button and latch placed at the pivot point of the articulated shaft, is taught in U.S. Pat. No. 3,419,295 issued Dec. 31, 1968 to Samuel N. Small.

The following patent are directed to umbrella constructions having articulated shafts and useful with boats, to protect the occupants from the elements. U.S. Pat. No. 2,559,421 issued Jul. 3, 1951 to Jesse M. Garrett discloses an umbrella with a pivoting shaft, the umbrella being tilted to any number of positions, but using a pivot with a knob lock located directly at the pivot point of the shaft. In U.S. Pat. No. 3,765,434 issued Oct. 16, 1973 to Royal W. Riggs, another multiple articulated umbrella shaft construction is seen, but again the key or lock for the pivot adjustment or setting of the shaft is located at the shaft intermediate pivot point.

Another pivoting shaft assembly for an umbrella, with the latch mechanism again being located at the pivot point is taught in U.S. Pat. No. 3,145,720 issued Aug. 25, 1964 to Giichi Torii. Another umbrella tilting mechanism, wherein the two parts of the umbrella shaft are pulled apart slightly and then repositioned to set a tilted attitude to the umbrella is disclosed in U.S. Pat. No. 2,906,278 issued Sep. 29, 1959 to Samuel N. Small. Finally, a tilting umbrella having a pivot located between the ribs and stretchers of the articulated umbrella shaft is taught in U.S. Pat. No. 5,086,797 issued Feb. 11, 1992.

The prior art as just discussed in detail is not directed to an umbrella construction including an articulated or pivoted umbrella shaft, operable remotely from the pivot, and useful to cover the open upper end of a golf bag or, alternatively, readily detachable from the bag for use to protect the golfer.

Thus, none of the above inventions and patents, taken either singly or in combination, is seen to describe the instant invention as claimed.

SUMMARY OF THE INVENTION

Accordingly, it is a principal object of the invention to provide a compact umbrella for attachment to and ready detachment from a golf bag, the umbrella configured to protect the open end of a golf bag, and including a remotely operated shaft pivot to tilt the umbrella to a selected position over the upper end of the bag, to protect the bag and clubs therein from the elements.

It is another object of the invention to provide a golfer's umbrella which includes a pivoting or articulated shaft that may be adjusted by the use of only one hand.

It is a further object of the invention to provide a tilting umbrella having two or more ribs of substantial construction, to prevent the umbrella from becoming everted in the event of moderate or even high wind conditions.

Still another object of the invention is to provide a golfer's umbrella of uncomplicated construction and including an articulated or pivoted shaft which is delatched and relatched from the handle of the umbrella, remote from the shaft pivot point.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 2 is a partial section view of the umbrella articulated shaft, showing internal construction details.

FIG. 3 is a detail front elevational view of the shaft subassembly, partly in section, and taken from the right hand side of FIG. 2.

Similar reference characters denote corresponding features consistently throughout the attached drawings.

DETAILED DESCRIPTION OF THE PREFERRED EMBODIMENTS

Figure 1:
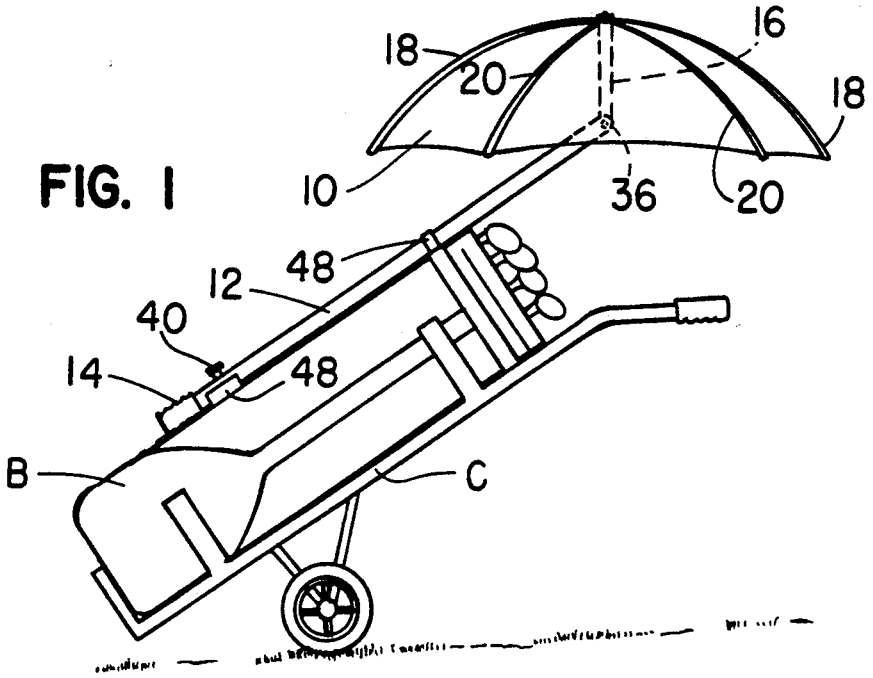
FIG. 1 is a side elevational view of the invention showing the invention attached to a conventional golf bag and cart assembly, with the umbrella shaft tilted and the umbrella open.
Figure 4:
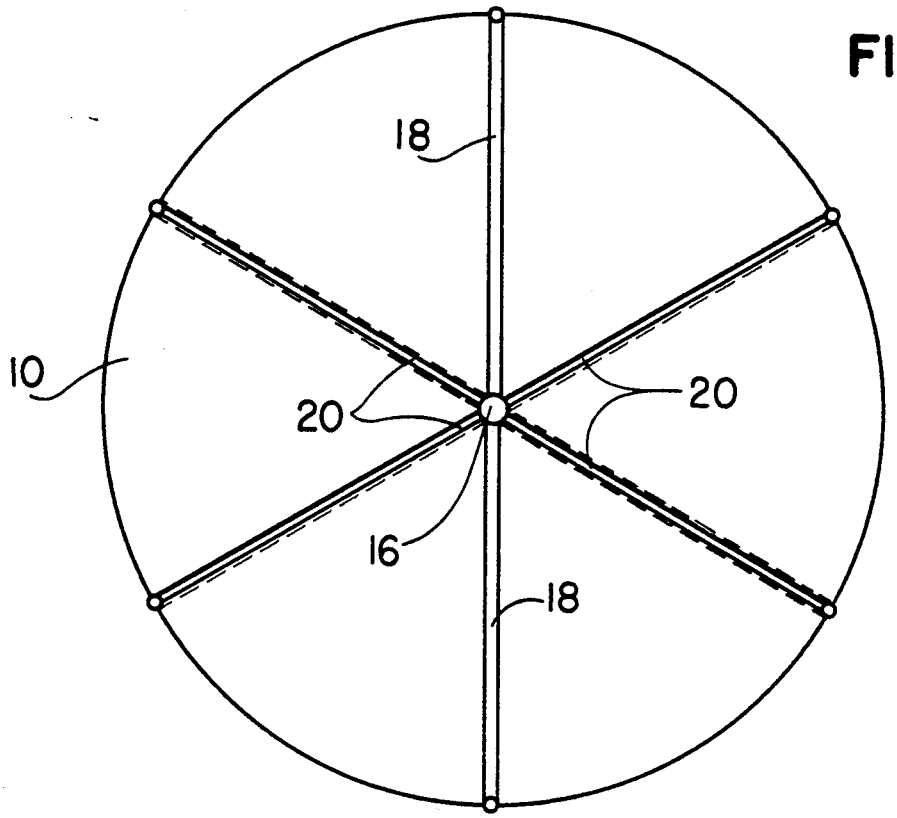
FIG. 4 is a somewhat diagrammatic view of the inside of an open umbrella of the invention, showing strengthening ribs, the stretchers being eliminated from the view for clarity of the view.

The present invention is seen in FIG. 1, attached to a conventional golf bag B which is mounted in an equally conventional golf cart C having a towing handle. The umbrella assembly of the invention includes an umbrella 10, mounted on an articulated shaft which is made up of a first elongate shaft member 12, having a handle grip 14 at its lower end, and a short length pivot shaft section 16 at an end opposite the handle grip 14. Turning now to FIG. 4, it will be appreciated that at least a pair of oppositely extending ribs 18 of umbrella 10 may be made of increased size, yet remain flexible enough so that the umbrella 10 can be opened and closed in a conventional fashion. The extra thickness or width imparted to at least ribs 18 help to assure that the umbrella will not accidentally become everted in the event of a moderate or even high wind, such conditions often being encountered when playing golf in inclement weather. In a preferred embodiment, these strengthened ribs 18 would be made of the same material as is conventional, e.g., metal, but would be approximately twice as wide as standard umbrella ribs, and about 20 percent thicker. Thus, increased strength is provided without seriously compromising flexibility. If desired, the remaining ribs could be similarly strengthened, as indicated by the dash lines adjacent the remaining ribs 20, 20, 20, 20 of umbrella 10. Other than this strengthening structure just described, the construction and operation of umbrella 10 is conventional. Thus, the conventional umbrella stretchers for each rib and a slide, latch and lock mechanism for opening, closing and latching the umbrella in open or closed position, are not illustrated. Suffice it to note here that these mechanisms would be located on and in association with the upper pivot section 16 of the articulated shaft assembly.

Referring now to FIGS. 2 and 3, the remotely controlled latching and pivot assembly for the articulated umbrella shaft will be discussed. An elongate actuating and latching rod 22 extends through shaft member 16. Its lower end is encased in a handle grip chamber 24, housing a compression coil spring 26, seated against a washer 28, affixed to rod 22 as shown. Thus, rod 22 is urged upwardly, in the sense of FIG. 2. The upper end 30 of rod 22 is selectively positioned in one of a series of bores 32 formed in lower end 34 of pivot shaft section 16, which is pivotally attached to rod 22 by a pivot pin 36. Five such bores 32 are shown in the drawings, spread through an arc of less than a half circle, as seen in FIG. 2. As few as three bores 32 could be provided, and the bores could be spread through a full semicircle, for greater adjustment in the angular positioning of the umbrella, if desired. Clearly, if rod 22 is withdrawn, downwardly in the sense of FIG. 2 form a bore 32, then section 16 may be rotated to adjust the upper end of the umbrella and shaft 16 to a new angular disposition with respect to elongate shaft 12, whereupon end 30 of rod 22 is inserted in a different bore 32.

The movement of rod 22 against the urging of spring 26 is controlled ny a latch key 36, mounted transversely of rod 22, in a slot 38 formed in the lower end of shaft member 12, adjacent handle grip 14. Key 38 is equipped with a thumb or finger button 40 on one end and secured in place by a threaded nut 42 on the other end. The key 38 has a lower, angled cam surface 44 abutting and in sliding contact with a cutout segment 46 formed in rod 22. Thus, when key 38 is depressed, cam surface 44 is urged against the lower end of cutout 46 and forces the rod 22 downwardly, against the urging of spring 26, and rod end 30 is withdrawn from a bore 32. After repositioning of the upper pivot section 16, button 40 is released, thus allowing key 38 to be forced outwardly as the spring 26 urges rod 22 upwardly, and rod end 30 is latched into a bore 32. Of course, FIGS. 2 and 3 illustrate the latched position.

The convenience of the invention to a golfer may now be readily appreciated. Should the weather turn rainy during a round of golf, the golfer may open the umbrella, latched, conveniently, to the side of bag B by one or more spring clips or clamps 48, 48. Of course, clips 48 may be strapped to bag B, may be formed as an integral part thereof, or could be a part of the golf cart C. Now, prior to taking a stroke, the golfer may wish to use the umbrella in conventional fashion—to keep himself or herself dry during walking about the golf course. Before taking a stroke, the golfer may place the umbrella in the clips 48, as shown in FIG. 1, and proceed to play. After play, the umbrella may be removed from the clips and used to protect the golfer. While a stroke is taken, the umbrella protects the open end of the golf bag B and the clubs therein.

One handed adjustment of the umbrella is very easily accomplished with one hand, by placing the umbrella, either opened or closed, against the ground, depressing button 40 to release the upper end of the shaft assembly as just described above, tilting the lower elongate shaft 12 to a new position, and then releasing button 40 to latch the assembly in a new angular position. The convenience advantages over conventional articulated umbrella assemblies, having hand or finger operated latches on or adjacent the pivot point of the assembly, are clear.

Of course, a golf cart C of the pull type is illustrated in FIG. 1. The invention can just as easily be used with a riding cart. Furthermore, given the uncomplicated nature of both the clamps 48 and the umbrella assembly, the invention may be provided as original equipment with a bag during manufacture, or the invention may be provided as an after market add-on. The invention is made of a minimum number of parts so as to be low in cost of manufacture and also unlikely to fail during use.

It is to be understood that the present invention is not limited to the embodiments described above, but encompasses any and all embodiments within the scope of the following claims.

I claim:

1. A golf bag umbrella assembly comprising:

a first, elongate shaft member having an upper end and a lower end and further having a latching rod mounted centrally therewithin, said elongate shaft including spring means urging said rod outwardly of said elongate shaft upper end;

clip mounting means for releasably attaching said elongate shaft to a golf bag;

a second, short length shaft section pivotally attached to said first member, and having an upper end and a lower end;

a plurality of latching bores arranged in circular fashion in said short shaft section lower end, and disposed for selective reception of said latching rod, thus to adjust the angular disposition of said short shaft with respect to said elongate shaft;

umbrella assembly mounted onto said short shaft upper end; and key means slidably mounted through said elongate shaft, adjacent said lower end thereof, for moving said rod away from said short shaft, against the urging of said spring means; whereby said short shaft and umbrella may be pivotally moved relative to said elongate shaft by depressing said key to remove said rod upper end from a latching bore, thus to allow said short shaft to pivot relative to said elongate shaft, and said shafts to be fixed relative one another by releasing said key, thus to permit said latching rod to enter a selected one of said latching bores.

2. The golf bag umbrella as claimed in claim 1 wherein said elongate shaft lower end includes handle grip means.

3. The golf bag umbrella assembly as claimed in claim 1 wherein said umbrella assembly includes a plurality of ribs wherein two of said ribs are at least approximately twice as wide and about twenty percent thicker than the other ribs of the umbrella, thus to make said umbrella assembly resistant to everting.

4. The golf bag umbrella assembly as claimed in claim 1 wherein said rod includes a cutout segment adjacent said key and said key includes a lower, angled cam surface in cooperative engagement with said cutout segment whereby depression of said key causes said cam to force said cutout and rod against the urging of said spring, thus to release said rod upper end from a latching bore.

5. The golf bag umbrella assembly as claimed in claim 1 wherein said clips, said elongate and short shafts and said umbrella assembly are dimensioned and configured such that, with said umbrella opened and said elongate shaft mounted in said clips, said umbrella assembly covers substantially the open upper end of the golf bag upon which said clips are mounted.

* * * * *